US007475626B2

(12) United States Patent
Grünewald

(10) Patent No.: US 7,475,626 B2
(45) Date of Patent: Jan. 13, 2009

(54) DEVICE FOR FEEDING PROPELLANT CHARGES TO A HEAVY WEAPON

(75) Inventor: Jens Grünewald, Kassel (DE)

(73) Assignee: Krauss-Maffei Wegmann GmbH & Co. KG (DE)

( * ) Notice: Subject to any disclaimer, the term of this patent is extended or adjusted under 35 U.S.C. 154(b) by 7 days.

(21) Appl. No.: 11/597,088

(22) PCT Filed: May 14, 2005

(86) PCT No.: PCT/DE2005/000888

§ 371 (c)(1),
(2), (4) Date: Nov. 17, 2006

(87) PCT Pub. No.: WO2005/116564

PCT Pub. Date: Dec. 8, 2005

(65) Prior Publication Data

US 2008/0047417 A1 Feb. 28, 2008

(30) Foreign Application Priority Data

May 26, 2004 (DE) ..... 10 2004 025 742

(51) Int. Cl.
*F41A 9/00* (2006.01)

(52) U.S. Cl. ..... 89/45; 89/35.01

(58) Field of Classification Search ..... 89/45–47, 89/33.01, 33.25, 33.5, 35.01
See application file for complete search history.

(56) References Cited

U.S. PATENT DOCUMENTS 3,897,368 A 7/1975 Ohara et al.
4,418,607 A * 12/1983 Price ..... 89/33.25
5,111,730 A * 5/1992 Grabner ..... 89/45
5,111,731 A * 5/1992 Grabner ..... 89/46

(Continued)

FOREIGN PATENT DOCUMENTS

DE 197 34 975 7/1949

(Continued)

OTHER PUBLICATIONS

Article, Chemical Engineering Science 59 (2004) 5329-5336, "A multifunctional filter . . . gases".

*Primary Examiner*—Stephen M Johnson
*Assistant Examiner*—Daniel J Troy
(74) *Attorney, Agent, or Firm*—Robert W. Becker; Robert W. Becker & Assoc.

(57) ABSTRACT

A device for feeding propellant charges to a heavy weapon, comprising a fixed propellant charge magazine having guides for receiving propellant charge modules such that their longitudinal axes extend horizontally. The guides are disposed parallel to one another and in horizontal planes above one another. A propellant charge feed mechanism for removing propellant charges from the magazine and transferring them to a propellant charge transfer arm includes an automatic feed mechanism disposed adjacent to the magazine and having a propellant charge chain driven in a vertical plane and provided with receiving elements for propellant charge modules. A portioning unit is disposed at the removal position at the upper end of the chain and axially relative to a respectively uppermost receiving element. The portioning unit has a mechanism for transferring and joining propellant charge modules. A mechanism is provided for transferring joined modules from the portioning unit to a propellant charge feed tray.

13 Claims, 6 Drawing Sheets

U.S. PATENT DOCUMENTS

| | | | | | |
|---|---|---|---|---|---|
| 5,170,006 | A | * | 12/1992 | Maher et al. | 89/46 |
| 5,347,908 | A | * | 9/1994 | Mouterde et al. | 89/34 |
| 5,456,154 | A | * | 10/1995 | Golden | 89/33.16 |
| 5,458,044 | A | * | 10/1995 | Delbos | 89/33.1 |
| 5,837,923 | A | * | 11/1998 | Gay et al. | 89/46 |
| 5,844,163 | A | * | 12/1998 | Lindskog | 89/46 |
| 6,048,159 | A | * | 4/2000 | Nicolas et al. | 414/416.01 |
| 6,073,534 | A | * | 6/2000 | Gagnon | 89/45 |
| 6,205,904 | B1 | * | 3/2001 | Boutet et al. | 89/45 |
| 6,354,183 | B1 | * | 3/2002 | Hallqvist | 89/45 |
| 6,446,536 | B1 | * | 9/2002 | Lindskog et al. | 89/45 |
| 6,877,414 | B1 | * | 4/2005 | Minard et al. | 89/34 |
| 2006/0162541 | A1 | | 7/2006 | Heldmann et al. | |

FOREIGN PATENT DOCUMENTS

| | | |
|---|---|---|
| EP | 0 681 870 | 11/1995 |
| EP | 0715 889 | 6/1996 |
| GB | 1 283 737 | 8/1972 |

* cited by examiner

DEVICE FOR FEEDING PROPELLANT CHARGES TO A HEAVY WEAPON

This specification for the instant application should be granted the priority date of May 26, 2004, the filing date of the corresponding German patent application 10 2004 025 742.6 as well as the priority date of May 14, 2005, the filing date of the corresponding International patent application PCT/DE2005/000888.

BACKGROUND OF THE INVENTION

The present invention relates to a device for feeding propellant charges to a heavy weapon, and includes at least one propellant charge magazine and a propellant charge feed mechanism for removing propellant charges from the propellant charge magazine and transferring them to a propellant charge transfer arm that is provided with a propellant charge feed tray that is pivotable into the region behind the weapon and has a propellant charge rammer. A device of this type is basically known and is described, for example, in DE 102 58 263.7 A1.

The object of the invention is to provide a device having the aforementioned features, which has a construction that is as compact as possible so that the often limited interior within a tank turret or the turret housing of a firing unit is obstructed as little as possible and yet the fully automatic supply of propellant charges from the propellant charge magazine to the weapon is ensured. The device should furthermore have such a construction that the possibility is provided of arranging the propellant charge magazine, and at least parts of the propellant charge feed mechanism, within an auxiliary housing that is removably or pivotably disposed on the outer wall of a turret housing.

SUMMARY OF THE INVENTION

A basic concept of the invention is that one or more propellant charge magazines are embodied as fixed magazines in which the propellant charges are disposed in guides with horizontally oriented longitudinal axes, whereby a plurality of propellant charge modules are disposed axially successively in each guide. The guides are respectively disposed parallel to one another and in horizontal planes above one another. Disposed directly next to the propellant charge magazine, or also between two propellant charge magazines, is an automatic propellant charge feed magazine that includes a propellant charge chain that circulates in a vertical plane and on which are disposed receiving elements, whereby the arrangement of the guides of the propellant charge magazine and of the receiving elements of the automatic propellant charge feed mechanism is such that the receiving elements can be brought into a position in which they are aligned with the guides, so that the propellant charge modules can be transferred out of the guides of the propellant charge magazine into the receiving elements of the propellant charge chain. Provided axially relative to the respectively uppermost receiving element of the automatic propellant charge feed mechanism is a portioning unit having means for the transfer and joining of a prescribed number of propellant charge modules from the receiving element into the portioning unit. The joined propellant charge modules are then supplied from the portioning unit to the propellant charge feed tray at the propellant charge transfer arm.

BRIEF DESCRIPTION OF THE DRAWINGS

In the following, an embodiment for a device for feeding propellant charges through a heavy weapon pursuant to the invention are explained in greater detail with the aid of the accompanying drawings, in which.

DESCRIPTION OF SPECIFIC EMBODIMENTS

FIGS. 1 to 5 show one embodiment for a device having a propellant charge magazine and a portion of the propellant charge feed mechanism comprising an automatic propellant charge feed mechanism and a portioning unit. The propellant charge magazine 2 is embodied as a fixedly disposed magazine in which propellant charge modules TM are disposed in guides 2.1 in such a way that their longitudinal axes extend horizontally.

Figure 2:
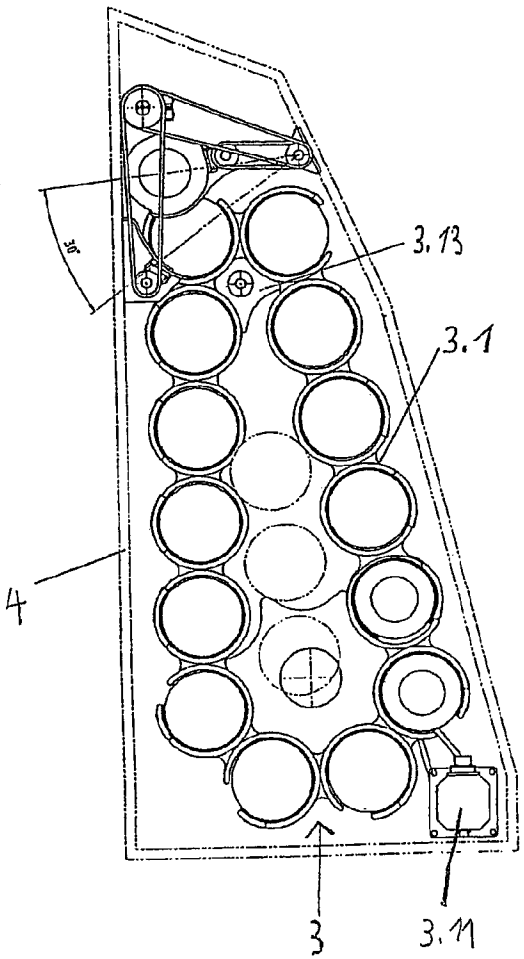
FIG. 2 is a side view of the device of FIG. 1.
Figure 1:
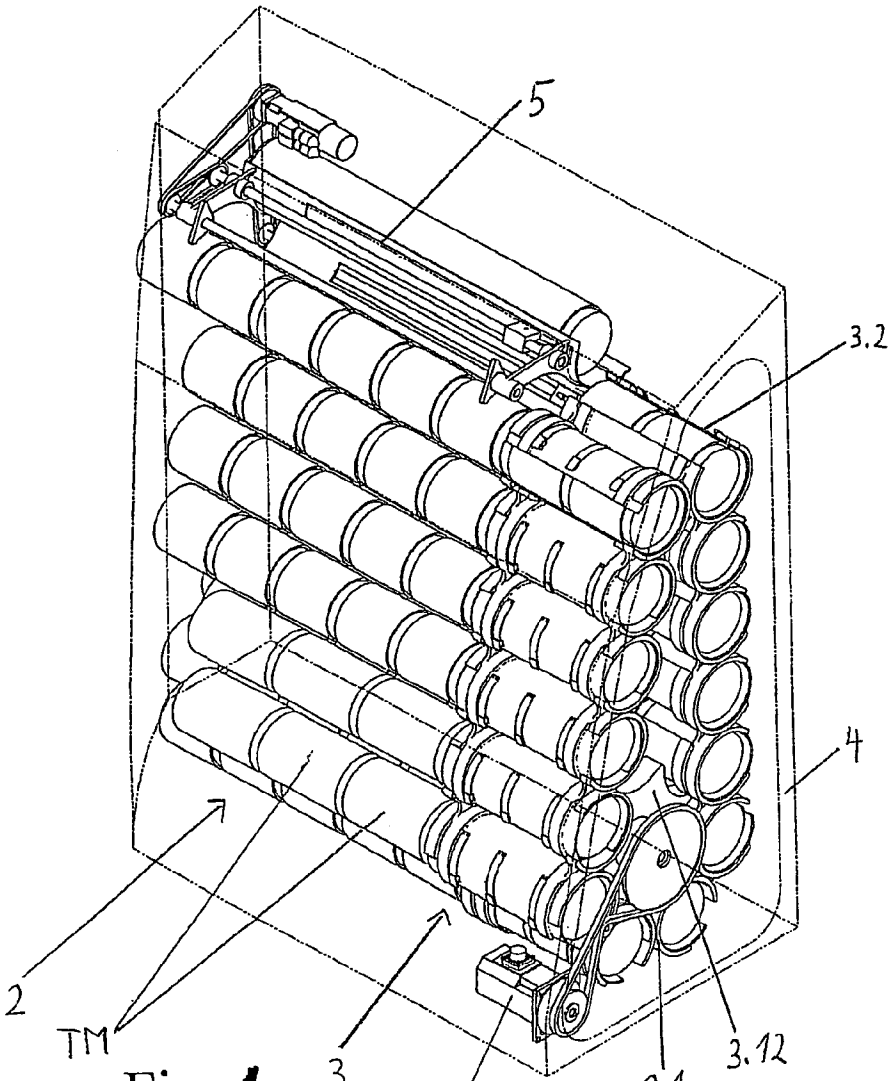
FIG. 1 is an isometric illustration of a propellant charge magazine having a propellant charge feed mechanism that is comprised of an automatic propellant charge mechanism and a portioning unit.
Figure 2A:
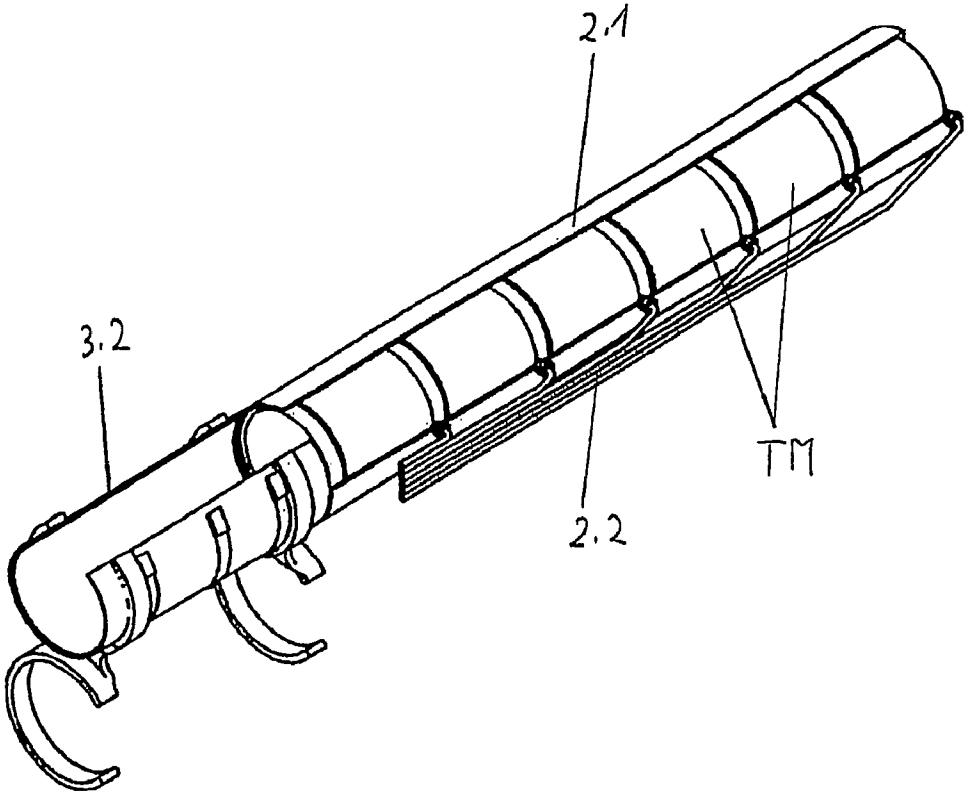
FIG. 2A is a detailed isometric illustration of a receiving tube of the propellant charge magazine, and of a receiving element of the automatic propellant charge mechanism of FIGS. 1 and 2.
Figure 3B:
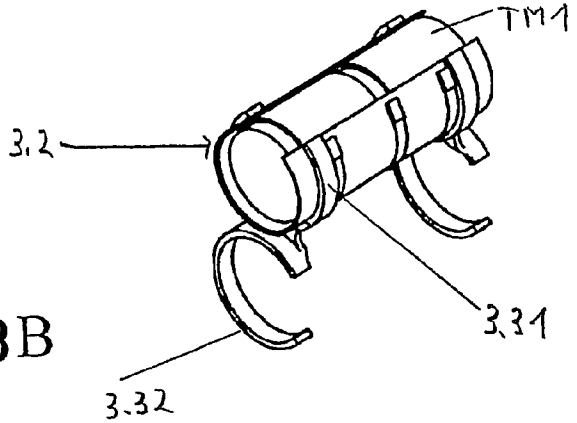
FIGS. 3B & 3C are detailed illustrations of receiving elements of the automatic propellant charge mechanism of FIG. 3A.
Figure 3C:
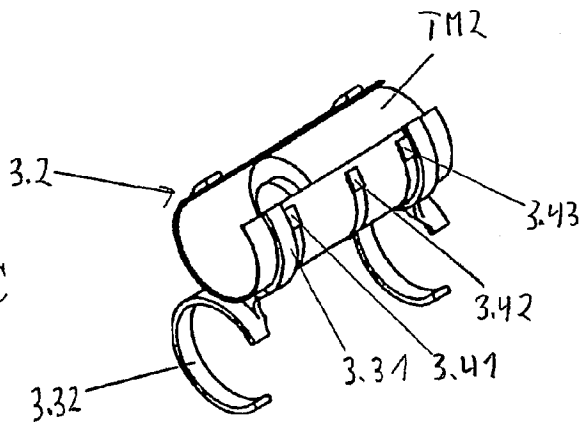
Figure 3A:
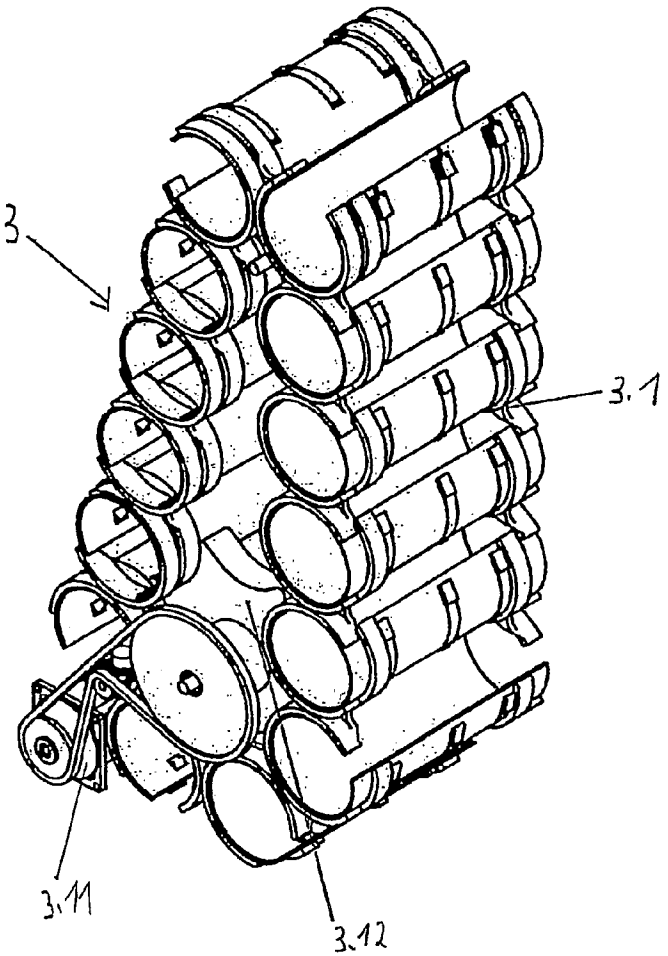
FIG. 3A is a detailed isometric illustration of the automatic propellant charge mechanism of FIGS. 1 and 2.
Figure 4A:
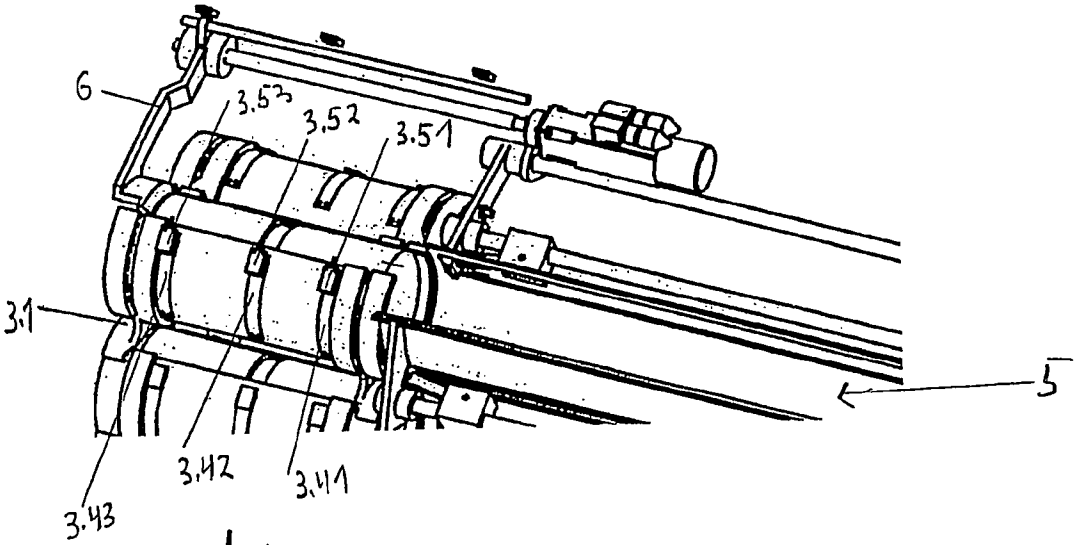
FIGS. 4A & 4B are isometric illustrations of the upper region of the automatic propellant charge mechanism with parts of the portioning unit in different states of loading.
Figure 4B:
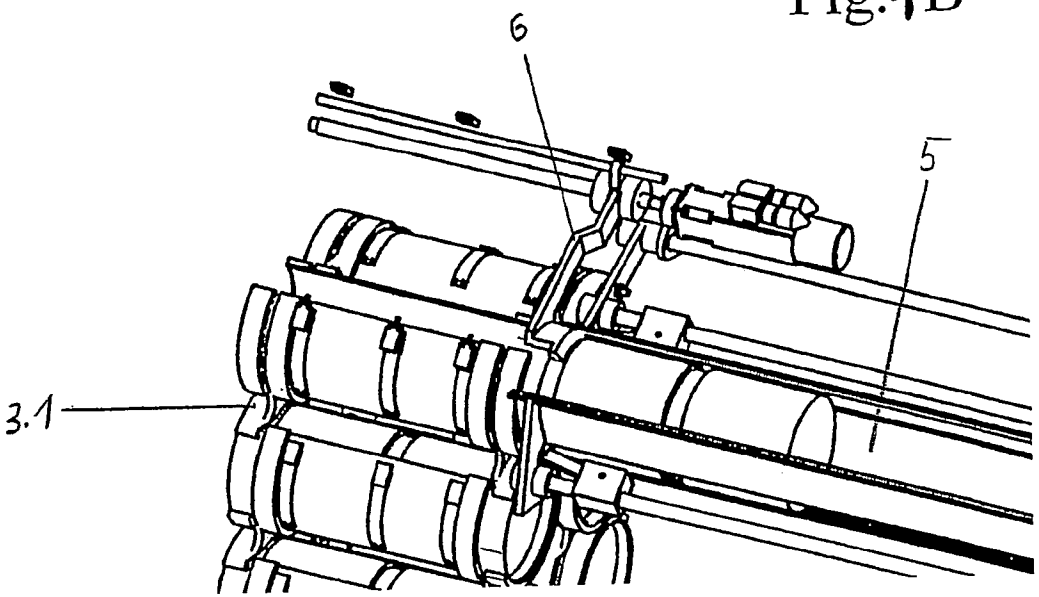
Figure 5:
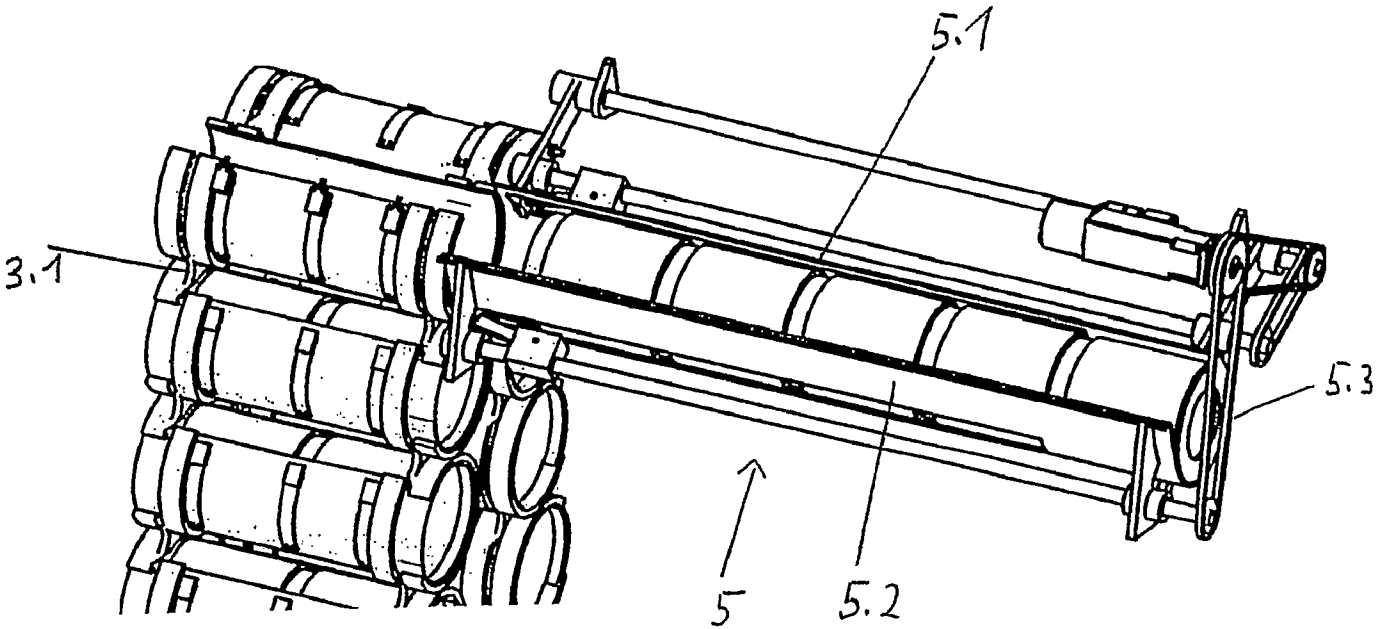
FIG. 5 is an isometric illustration of the upper region of the automatic propellant charge mechanism having the entire portioning unit in the filled state.

In the illustrated embodiment, the guides 2.1 are embodied as receiving tubes that, to facilitate illustration, are shown with their outer surface partially broken away. However, other guides, for example guide rails, could also be utilized at this location. As can be seen in FIGS. 1 and 2, a prescribed number of guides 2.1 are respectively disposed parallel to one another and above one another in horizontal planes. Disposed at one end face of the thus formed propellant charge magazine 2 is an automatic propellant charge feed mechanism 3 having a propellant charge chain 3.1 that circulates in a vertical plane and is driven by a motor 3.11; the propellant charge chain has receiving elements 3.2 to respectively receive one or two propellant charge modules TM, depending upon the axial length. The transfer of propellant charge modules TM, out of the receiving tubes 2.1 and into the receiving element 3.2 of the automatic propellant charge mechanism 3 can, if the receiving elements are aligned with the receiving tubes, be effected by the supply of positive air pressure via lines 2.2. During loading, negative air pressure can be supplied via these lines for feeding the propellant charge modules into the receiving tubes 2.1.

If the guides of the propellant charge magazine are embodied as open receiving trays or receiving rails, the supply and withdrawal of propellant charge modules can be effected in a non-illustrated manner via pick-up elements that are guided on spindles or circulating chains. Arresting catches can be disposed on the guides 2.1 of the propellant charge magazine 2 in a similarly non-illustrated manner.

The receiving elements 3.2 of the propellant charge chain 3.1 are embodied as open trays, and each chain link is respectively provided, in the region of the two ends of a tray, with a retaining clip that is composed of two circular ring segments 3.31 and 3.32 that contact one another and at the point of contact are interconnected. The arrangement is such that in each case the one circular ring segment 3.31 extends around the tray 3.2 of this chain link at the closed side, and the other circular ring segment 3.32 extends around the tray of an adjacent chain link at the open side. Each retaining clip is constructed in such a manner that the openings of the circular ring segments 3.31 and 3.32 are disposed at an angle of 90° relative to one another, and the retaining clips are disposed and guided in the propellant charge chain 3.1 in such a way that the receiving element 3.2 that is respectively in the removal position at the upper end of the propellant charge chain 3.1 has an open transport region that extends in the axial direction and through which a transfer element 6, which is displaceable in the axial direction and is embodied as a clamp or grab hook, can be guided in such a way that the propellant charge modules that are contained in this receiving element are transferred into a portioning unit 5 that is disposed above the propellant charge magazine 2, where they are joined or assembled. In at least a portion of the other positions of the receiving elements 3.2, the trays at the closed and at the opened side are completely surrounded by the cooperating circular ring segments 3.31 and 3.32 of two retaining clips.

Sensor elements, for determining the module type and the extent of filling, are disposed at each receiving element of the propellant charge chain 3.1. In the illustrated embodiment, the sensor elements are embodied as flexible strips 3.41 to 3.43 that are guided about the periphery of the trays 3.2 and have a detection element that extends through an opening of the tray; associated with the outer side of each flexible strip 3.41 to 3.43 is a proximity sensor or switch 3.51 to 3.53 that is respectively disposed across from the flexible strip. In the illustrated embodiment, three flexible strips 3.41 to 3.43 are disposed on each tray and are spaced apart by a prescribed axial distance. The length of the trays 3.2 is such that either two axially consecutive standard modules TM 1 (FIG. 3B), or one somewhat longer basic module TM 2 (FIG. 3C), can be accommodated, whereby in this case it can be precisely determined by the sensor elements which type and how many propellant charge modules are contained in the tray. Depending upon the type of filling and the extent of filling, some or all of the flexible strips 3.41 to 3.43 are pressed in a direction toward the proximity switches 3.51 to 3.53.

The propellant charge chain 3.1 is driven by the drive motor 3.11 via a sprocket wheel 3.12. The change in direction is effected in the upper region via a pinion 3.13.

In the region of the removal position, further sensors can be disposed for the control of the transfer of the propellant charge modules out of the receiving element 3.2 of the propellant charge chain 3.1 and into the portioning unit 5.

The portioning unit 5 has a receiving tray that is disposed axially relative to the receiving element 3.2 of the propellant charge chain 3.1 in the removal position, and is divided in the axial direction; the receiving tray has a large tray portion 5.1 that at the end remote from the propellant charge chain 3.1 is provided with an abutment 5.3 for the propellant charge modules, and a small tray portion 5.2 for the lateral support of the propellant charge modules. The large tray portion 5.1 is pivotable out of a receiving position into a delivery position for the transfer of the joined propellant charge modules TM to a propellant charge feed tray. The abutment 5.3 that is disposed at the end of the portioning unit 5 ensures that the propellant charge modules that are transferred by the grab hooks 6 into the portioning unit 5 are joined there prior to their delivery.

Figure 6:
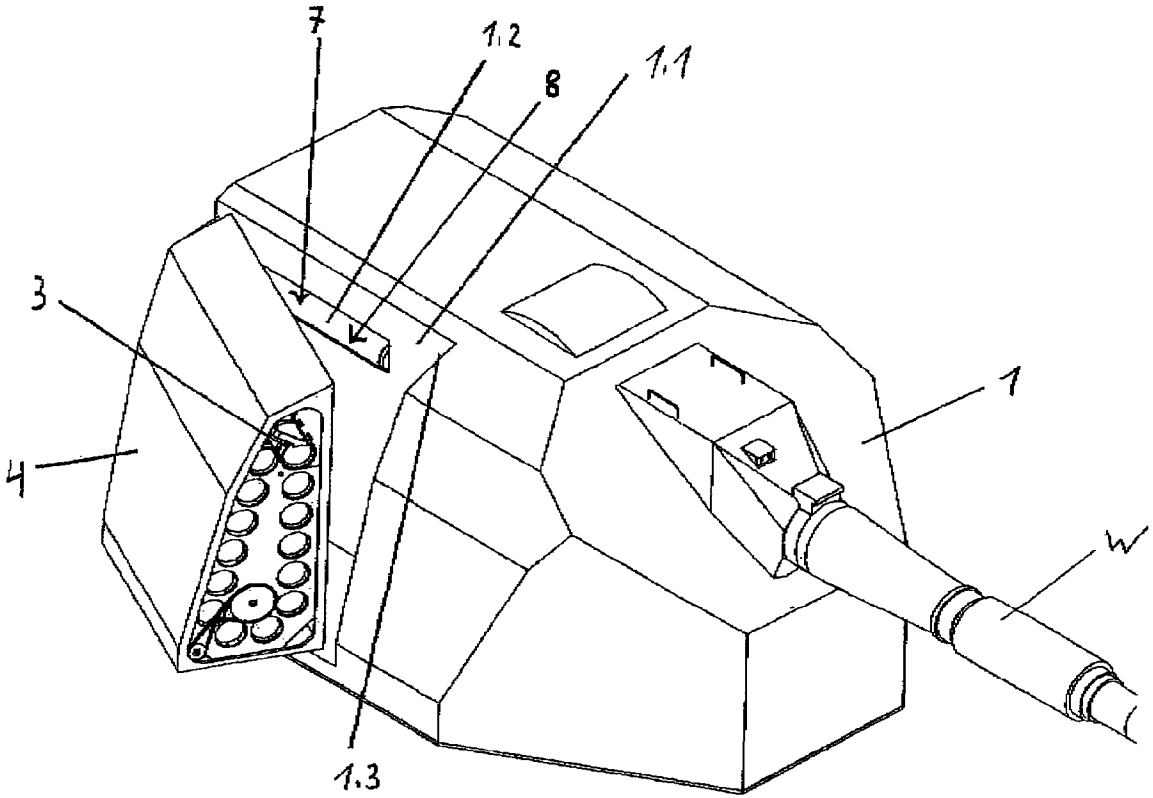
FIG. 6 is an isometric illustration of a firing unit having an auxiliary housing, which is pivotable from the turret housing, for receiving a device for feeding propellant charges to a heavy weapon.

FIG. 6 shows how the device described above can be disposed on the turret housing of a firing unit.

FIG. 6 shows a firing unit having an armored turret housing 1 in which a heavy weapon W is mounted so as to be pivotable in elevation about a trunnion in a manner not separately illustrated. The turret housing 1 can be mounted on a support structure, so as to be rotatable in azimuth, that can, for example, be embodied as an undercarriage of an armored howitzer or also of a tank. In a not separately illustrated but known manner, the turret housing contains at least one shell magazine from which shells are supplied to the weapon W by means of a known, fully automatic shell supply mechanism.

On the outside of the turret housing 1, on an outer wall 1.1, which is disposed within a resilient region 1.3 of the contour of the turret housing 1, an auxiliary housing 4 is pivotably attached about a vertical axis in such a way that, as can be seen from FIG. 6, the auxiliary housing 4 can be moved out of a position where it rests sealingly against the turret housing into a position where it is pivoted outwardly. Disposed within the auxiliary housing 4 is the propellant charge magazine 2 as well as the automatic propellant charge feed mechanism 3, via which the propellant charges are removed from the propellant charge magazine 2 and are supplied to the portioning unit 5. For this purpose, the auxiliary housing 4 is provided on that side that faces the turret housing 1 with an opening that is not visible in FIG. 1 and opposite of which, in the outer wall 1.1 of the turret housing 1, is disposed a correspondingly configured opening 1.2.

In the delivery position of the large tray portion 5.1 of the portioning unit 5, the joined propellant charge is ejected through the openings in the auxiliary housing 4 and in the outer wall 1.1 of the turret housing 1. Within the turret housing 1, the propellant charge is then received by the propellant charge feed tray 8 which, is disposed on the propellant charge transfer arm 7 that is disposed in the turret housing 1 and can be pivoted into the region behind the weapon W, so that it can be supplied to the weapon by means of a propellant charge rammer that is disposed thereon.

In the illustrated embodiment, a propellant charge magazine 2 is shown that has an automatic propellant charge feed mechanism 3 at one end face. Of course, a propellant charge magazine can be disposed at both sides of the automatic propellant charge mechanism, and the portioning unit can be disposed above one of the two propellant charge magazines.

The specification incorporates by reference the disclosure of German priority document 10 2004 025 742.6 filed May 26, 2004 and PCT/DE2005/000888 filed May 14, 2005.

The present invention is, of course, in no way restricted to the specific disclosure of the specification and drawings, but also encompasses any modifications within the scope of the appended claims.

The invention claimed is:

1. A device for feeding propellant charges to a heavy weapon, comprising:

at least one propellant charge magazine embodied as a fixed magazine and having guides, wherein propellant charge modules are adapted to be disposed in said guides such that their longitudinal axes extend horizontally, wherein a prescribed number of propellant charge modules are adapted to be disposed axially successively in each of said guides, and wherein a prescribed number of said guides are disposed parallel to one another and in horizontal planes above one another;

a propellant charge feed mechanism adapted to remove propellant charges from said at least one propellant charge magazine and transfer them to a propellant charge transfer arm that is provided with a propellant charge feed tray that is adapted to be pivoted into a region behind the weapon, wherein said propellant charge feed mechanism includes an automatic propellant charge feed mechanism that is disposed adjacent to said at least one propellant charge magazine and has a propellant charge chain that is driven in a circulating manner in a vertical plane, wherein said propellant charge chain is provided with receiving elements adapted to receive at least one propellant charge module and with means for transferring said propellant charge modules from said guides of said at least one propellant charge magazine into said receiving elements of said propellant charge chain, wherein said receiving elements of said propellant charge chain are embodied as open trays, wherein said propellant charge chain is composed of chain links, each of which, in the region of an end of a tray, is provided with a retaining clip composed of two circular ring segments that contact one another and are interconnected at the point of contact, and wherein one of said circular ring segments extends around the tray of this chain link at a closed side while the other of said circular ring segments extends about a tray of an adjacent chain link on an open side;

a portioning unit disposed at a removal position at an upper end of said propellant charge chain and axially relative to a respectively uppermost one of said receiving elements, wherein said portioning unit is provided with means for transferring and joining a prescribed number of said propellant charge modules; and means for transferring joined propellant charge modules from said portioning unit (5) to said propellant charge feed tray.

2. A device according to claim 1, wherein said guides in said at least one propellant charge magazine are embodied as receiving tubes that for a supply of propellant charge modules are adapted to be supplied with positive air pressure and for a withdrawal of propellant charge modules are adapted to be supplied with negative air pressure.

3. A device according to claim 1, wherein said guides in said at least one propellant charge magazine are embodied as open receiving trays or receiving ralls.

4. A device according to claim 1, wherein arresting catches are disposed on said guides of said at least one propellant charge magazine.

5. A device according to claim 1, wherein each of said retaining clips is constructed in such a way that the openings of the circular ring segments are disposed at an angle of 90° relative to one another, wherein said retaining clips are disposed and guided in said propellant charge chain in such a way that a receiving element located in the removal position has an open transport region, extending in the axial direction, for a transfer element, and wherein in at least some of the other positions, closed and open sides of the trays are completely surrounded by the circular ring segments of two retaining clips, which cooperate with one another.

6. A device according to claim 1, wherein sensor elements are provided on each receiving element of said propellant charge chain for determining the type of said propellant charge modules and an extent to which said at least one propellant charge magazine is filled.

7. A device according to claim 6, wherein said sensor elements are embodied as flexible strips that are guided about the periphery of said receiving elements and have a detection element that extends through an opening of said receiving element, and wherein a proximity sensor or switch is disposed across from an outer side of each of said flexible strips.

8. A device according to claim 7, wherein three of said flexible stips are disposed on each of said receiving elements and are spaced axially apart.

9. A device according to claim 1, wherein sensors are fixedly disposed in a region of the removal position for a control of a transfer of said propellant charge modules out of said receiving element of said propellant charge chain and into said portioning unit.

10. A device according to claim 1, wherein said means of said portioning unit for transferring and joining propellant charge modules from said receiving element of said propellant charge chain into said portioning unit is provided with at least one grab hook, as a transfer element, that is movable parallel to the axial direction of said receiving element and of said portioning unit

11. A device according to claim 1, wherein said portioning unit (5) includes a receiving tray that in the removal position is disposed axially relative to the receiving element of the propellant charge chain, wherein said receiving tray is divided in the axial direction, comprising a large tray portion, which is provided with an abutment for said propellant charge modules on an end remote from said propellant charge chain, and a small tray portion for a lateral support of said propellant charge modules, and wherein said large tray portion (5.1) is pivotable out of a receiving position into a delivery position for transfer of joined propellant charge modules to said propellant charge feed tray.

12. A devce according to claim 11, wherein said at least one propelant charge magazine, said automatic propellant charge feed mechanism and said portioning unit are adapted to be disposed within an auxiliary housing that is removably or pivotably disposed on an outer wall of an armored turret housing of a firing unit, wherein respectively aligned openings for propellant charges that are to be transferred out of said auxiliary housing and into said turret housing are disposed in said outer wail of said turret housing and in an outer wall of said auxiliary housing that is disposed across from said outer wall of said turret housing, and wherein said propellant charge transfer arm that is provided with said propellart charge feed tray is disposed within said turret housing.

13. A device according to claim 12, wheren in the delivery position of said large tray portion the joined propellant charge modules are adapted to be ejected through the openings of said auxiliary housing and of said outer wall of said turret housing.

* * * * *